US005735153A

United States Patent [19]

Hanneman et al.

[11] Patent Number: 5,735,153

[45] Date of Patent: *Apr. 7, 1998

[54] PIN TUMBLER CYLINDER LUCK WITH SHEARABLE ASSEMBLY PINS AND METHOD AND APPARATUS OF MANUFACTURE

[75] Inventors: Robert Harold Hanneman, Wind Lake; James George Wagner, West Bend; Steven A. Fantl, Colgate, all of Wis.

[73] Assignee: Master Lock Company, Milwaukee, Wis.

[ * ] Notice: The term of this patent shall not extend beyond the expiration date of Pat. No. 5,697,239.

[21] Appl. No.: 834,141

[22] Filed: Apr. 14, 1997

Related U.S. Application Data

[63] Continuation of Ser. No. 684,752, Jul. 19, 1996, Pat. No. 5,697,239, which is a continuation of Ser. No. 388,950, Feb. 15, 1995, abandoned, which is a continuation-in-part of Ser. No. 293,368, Aug. 19, 1994, abandoned, which is a continuation-in-part of Ser. No. 110,264, Aug. 23, 1993, abandoned.

[51] Int. Cl.[6] ..... E05B 27/04

[52] U.S. Cl. ..... 70/493; 29/426.4; 29/434; 70/360; 70/375; 70/383; 70/422; 225/2; 225/93

[58] Field of Search ..... 70/358, 360, 361, 70/493, 422, 375, 378, 392, 421, 382–385, 387, DIG. 75, 31, 50–52; 29/426.4, 434; 225/2, 93

[56] References Cited

U.S. PATENT DOCUMENTS

| | | | |
|---|---|---|---|
| 1,295,351 | 2/1919 | Morgan . | |
| 1,505,865 | 8/1924 | Costa | 70/360 |
| 1,650,568 | 11/1927 | Hurd . | |
| 1,828,747 | 10/1931 | Perry | 70/361 |
| 1,953,535 | 4/1934 | Hurd . | |
| 2,252,966 | 8/1941 | Fogelson . | |
| 2,555,316 | 6/1951 | Cerf, Jr. . | |
| 2,820,360 | 1/1958 | Soref et al. . | |
| 3,070,987 | 1/1963 | Baker et al. . | |
| 3,073,146 | 1/1963 | Patriquin . | |
| 3,078,705 | 2/1963 | Morrison, Jr. . | |
| 3,125,878 | 3/1964 | Gutman . | |
| 3,167,943 | 2/1965 | Schreiber et al. | 70/493 X |
| 3,175,378 | 3/1965 | Russell . | |
| 3,234,768 | 2/1966 | Russell et al. . | |
| 3,293,893 | 12/1966 | Chesler . | |
| 3,563,071 | 2/1971 | Barger . | |
| 4,103,526 | 8/1978 | Surko, Jr. | 70/419 X |
| 4,412,437 | 11/1983 | Smith | 70/338 |
| 4,440,009 | 4/1984 | Smith | 70/385 |
| 4,741,188 | 5/1988 | Smith | 70/383 |
| 5,211,044 | 5/1993 | Kim | 70/371 |

*Primary Examiner*—Lloyd A. Gall
*Attorney, Agent, or Firm*—Pennie & Edmonds, LLP

[57] ABSTRACT

A turnable lock operable with driver and tumbler pins when positioned by a key at a shear line in which shearable assembly pins are assembled in the lock and thereafter sheared to form such driver and tumbler pins for operation thereon. Each assembly pin is selectively weakened at a plurality of locations which correspond with notched depth heights of the family of keys capable of insertion in the keyhole. Such weakening is controlled so that pin shearing can be accomplished by application of rotational or linear forces applied to any part of the lock except the key. When linear forces are used the tumbler or plug may be indexed to employ a driver pin as a plug lock.

7 Claims, 14 Drawing Sheets

Fig 14

PIN TUMBLER CYLINDER LUCK WITH SHEARABLE ASSEMBLY PINS AND METHOD AND APPARATUS OF MANUFACTURE

This application is a continuation of U.S. patent application Ser. No. 08/684,752 filed Jul. 19, 1996, U.S. Pat. No. 5,697,239 which is, in turn, a continuation of U.S. patent application Ser. No. 08/388,950 filed Feb. 15, 1995, now abandoned, which is, in turn, a continuation-in-part of U.S. patent application Ser. No. 08/293,368 filed Aug. 19, 1994, now abandoned, which is, in turn, a continuation-in-part of U.S. patent application Ser. No. 08/110,264 filed Aug. 23, 1993, now abandoned.

BACKGROUND OF THE INVENTION

Prior cylinder locks have included a plurality of tumbler pins and aligned driver pins urged by springs against the key. The pins are separately manufactured to selected lengths prior to lock assembly.

It has also been proposed to install one-piece pins in a cylinder; accomplish selected elevation of the pins using a notched key and thereafter shear each pin, as held in such elevation by the notched key, into two lock pins (U.S. Pat. No. 1,953,535). Such prior method has the disadvantage that any second randomly-selected insertable key would be capable of elevating the pins and, if torqued, would again shear the pins thus compromising security.

SUMMARY OF THE INVENTION

Broadly, the present invention comprises a cylinder having a body, a turnable plug, a shear line therebetween, and a plurality of selectively weakened assembly pins for initial positioning by a notched key. The assembly pins are sheared by the manufacturer or locksmith using special machinery to thereafter function as both driver and tumbler pins. Such assembly pins are strong enough so that torquing or otherwise forcing with an insertable key by the lock user or person with an unauthorized key or similar tool will not shear them.

It is a feature of the invention that the assembly pins have a plurality of selectively weakened portions or zones to control shearings at selected points provided sufficient shearing force is applied.

It is a further feature of the invention that the driver and tumbler pins, though sufficiently weakened, are strong enough so that torquing of a key by hand or with a tool will cause the key or tool to fail before the pins shear.

BRIEF DESCRIPTION OF THE DRAWINGS

FIG. 12 is a front elevational view of a key-operated padlock which is a further embodiment of the invention with the plug of the shell-plug assembly protruding;

DESCRIPTION OF THE PREFERRED EMBODIMENT

Figure 1:
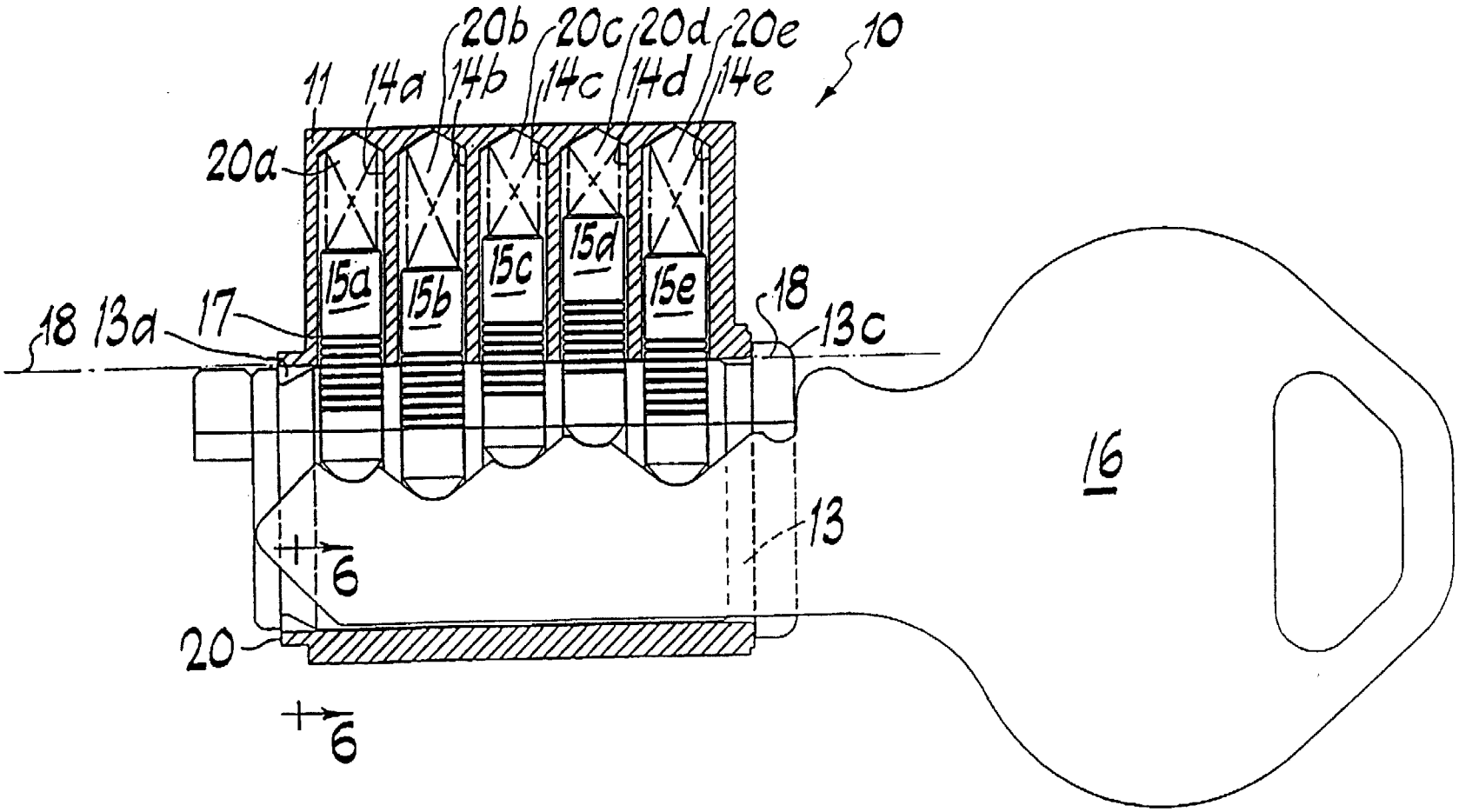
FIG. 1 is a side elevational cutaway view of the lock of the present invention including shell, plug and key-positioned assembly pins.
Figure 2:
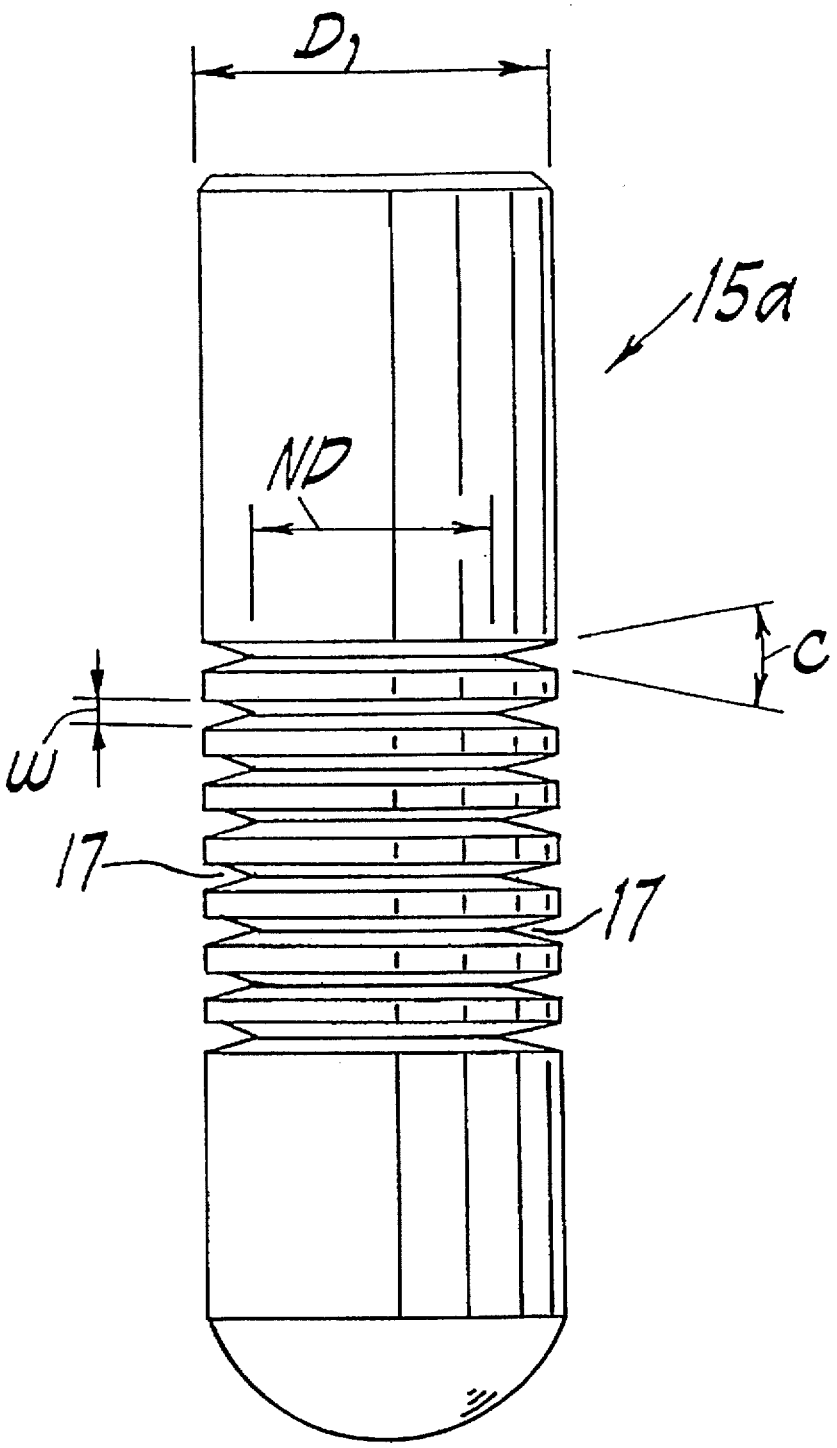
FIG. 2 is a side elevational view of an assembly pin of the present invention.
Figure 3:
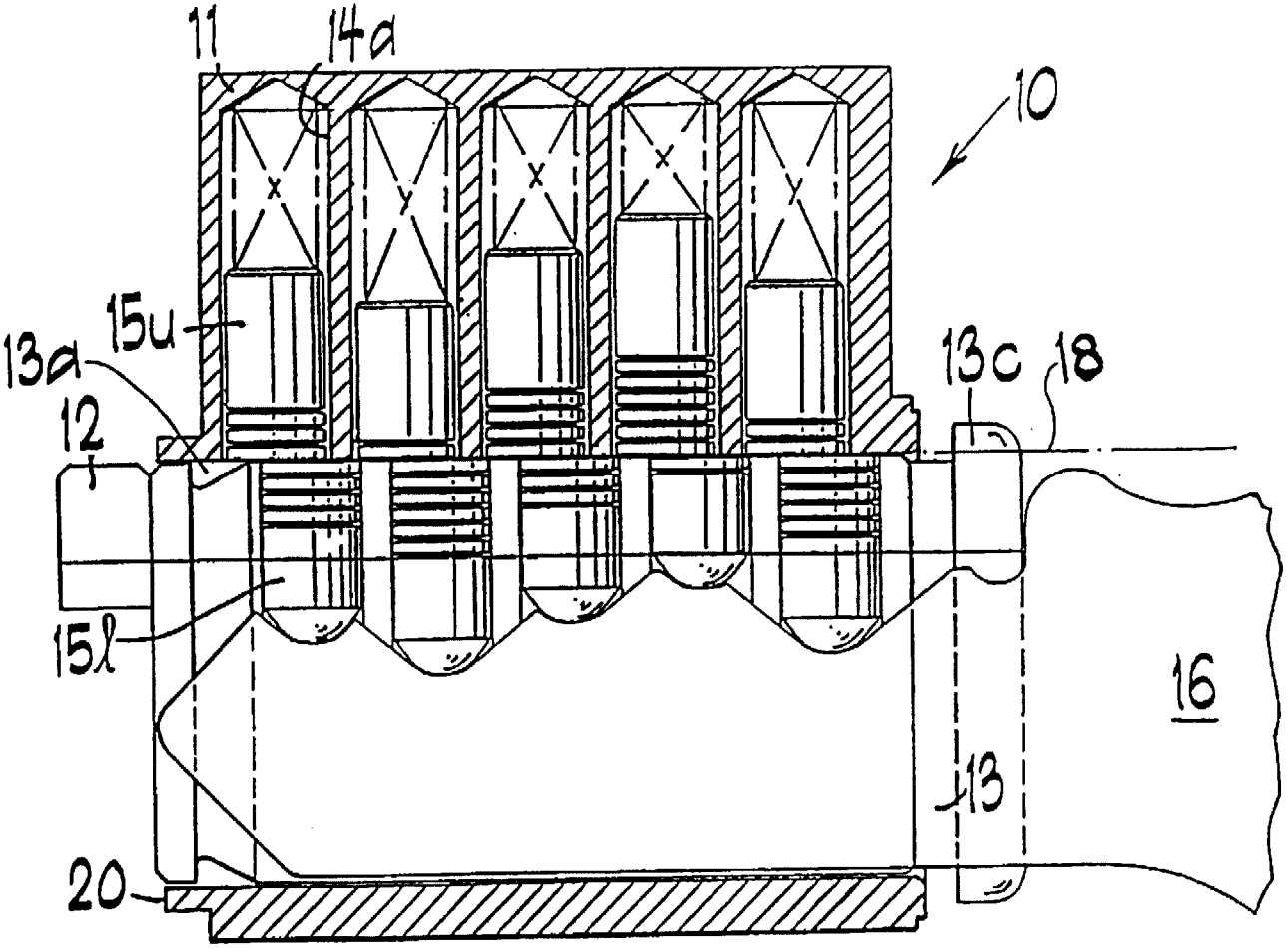
FIG. 3 is a view similar to FIG. 1 in which the pins have been sheared by relative lateral movement between the shell and plug.

In FIGS. 1–3, lock 10 includes a shell-plug assembly comprised of a cylinder shell 11, turnable cylinder plug 13, with plug collar 13*c*, and five (5) vertical pin passageways 14*a–e* extending up into the shell as shell 11 passageways and down into plug 13 as plug passageways. Also shown are five assembly pins 15*a–e*, plug tail 12, brass key 16, cylinder shear line 18 and pin springs 20*a–e* for the assembly pins 15*a–e*. Each assembly pin 15*a–e* has eight (8) circumferential weakened zones defined by notches or grooves 17. Pins 15*a–e* are made of selected material and their grooves 17 are shaped and proportioned to accomplish assembly pin shearing by the manufacturer or locksmith while preventing compromise in security while the lock is in service through use of an unauthorized key or other instrument. Different manufacturers have differing non-notch key configurations which allow the keys of a given manufacturer to be inserted in locks of that manufacturer.

Assembly pins of the invention are notched or otherwise selectively weakened to reduce the force taken to shear such pins; however, they are not weakened such that an insertable key (a key with the same keyway configuration on the lock key) with a different cut could be torqued by hand or by a tool to cause the driver and tumbler pins to shear prior to key or tool failure. The pin notches have a depth and shape such that only the force of factory or locksmith equipment applied to portions of the plug, and not applied to the key, can shear the pins. Forces applied to the key or directly to plug collar 13*c* in a direction parallel to the axis of rotation of plug 13 are resisted and absorbed by collar 13*c* engaging shell 11.

The following assembly pins, with varying notch diameters, were tested:

| Inner Notch Diameter | Average Force Per Pin To Shear |
|---|---|
| 0.060 inch | 95 lbs. |
| 0.062 inch | 105 lbs. |
| 0.065 inch | 120 lbs. |
| 0.070 inch | 140 lbs. |
| 0.074 inch | 155 lbs. |
| 0.079 inch | 180 lbs. |
| 0.084 inch | 205 lbs. |

Inner notch diameter (ND) was less than overall diameter or outside diameter D (see FIG. 2). An inner notch diameter of 0.062 inch is preferred for padlock pins. In the above tests D was 0.094 inch. Notch angle (C) was 20° (degrees) (FIG. 2). The ratio of ND to D is preferably in the range 63%–74%. The present invention also includes door hardware pins where an inner notch diameter of 0.074 inch is preferred for pins having an outside diameter (D) of 0.114 inch.

In the manufacture of cylinder 10, assembly pins 15*a–e*, each with eight (8) weakened zones defined by circumferential grooves 17, are fabricated for use in making a quantity of locks. In the present system, preferably keys have eight (8) different cut depths and five pin cylinders, creating thirty-two thousand (32,000) combinations. Each groove 17 has a width w (FIG. 2) of about 0.0060–0.010 inches and the series of grooves 17 are spaced vertically (as shown in FIG. 2) about 0.0156 inch apart. In the assembly of lock 10, assembly pins 15*a–e* (each of which is the same within a tolerance of ±0.0005) are placed into passageways 14*a–e* and then sheared. The series of spaced-apart grooves 17 are located in the assembly pins 15*a–e* such that they are positioned at the shear line 18 by a family of insertable keys.

Figure 6:
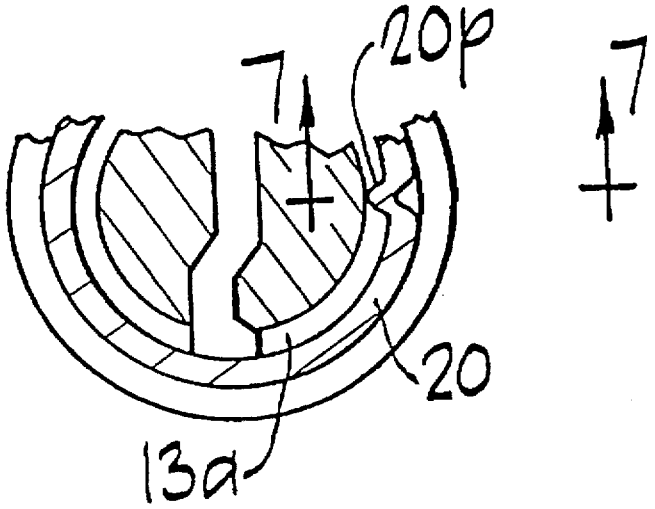
FIG. 6 is a partial sectional view along line 6—6 of FIG. 1.
Figure 7:
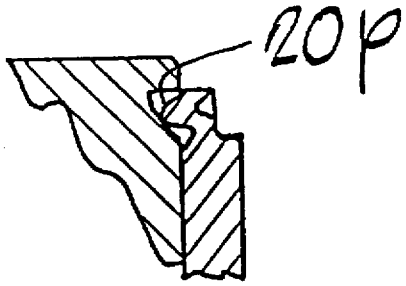
FIG. 7 is a partial sectional view along line 7—7 of FIG. 6.

FIG. 3 illustrates plug 13 being driven to the right to shear pins 15*a–e* as further explained below. As sheared, each assembly pin 15*a–e* breaks into an upper drive section 15*u* to function as a driver pin and aligned lower tumbler section 151 to function as a tumbler pin. Cylinder shell 11 has end ring portion 20 and plug 13 has angled portion 13*a* (FIG. 1). A segment 20*p* (FIGS. 6 and 7) of ring portion 20 is crimped against portion 13*a* as later described.

Figure 4:
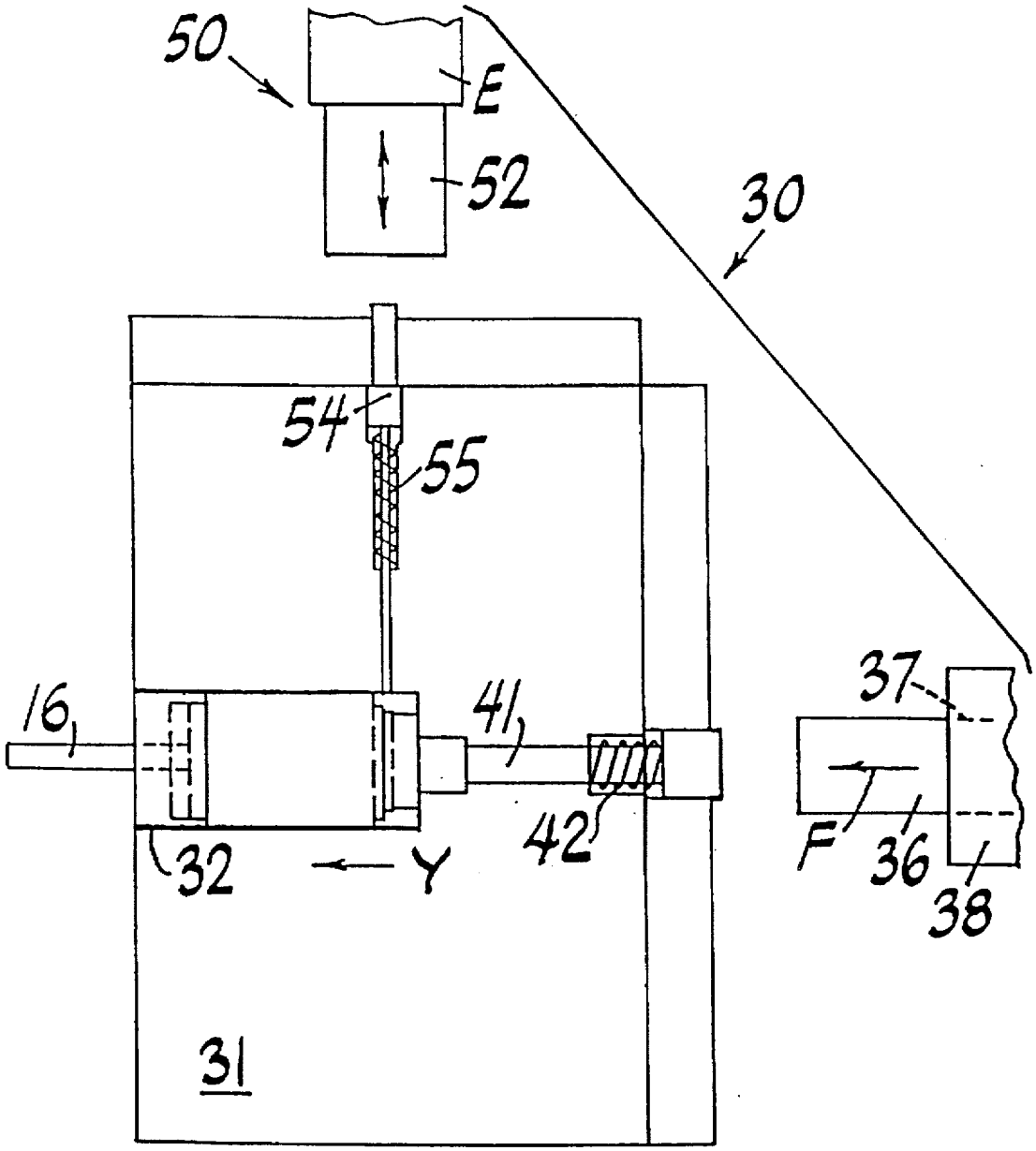
FIG. 4 is a plan view of the apparatus for shearing the assembly pins and crimping the shell and plug together.
Figure 5:
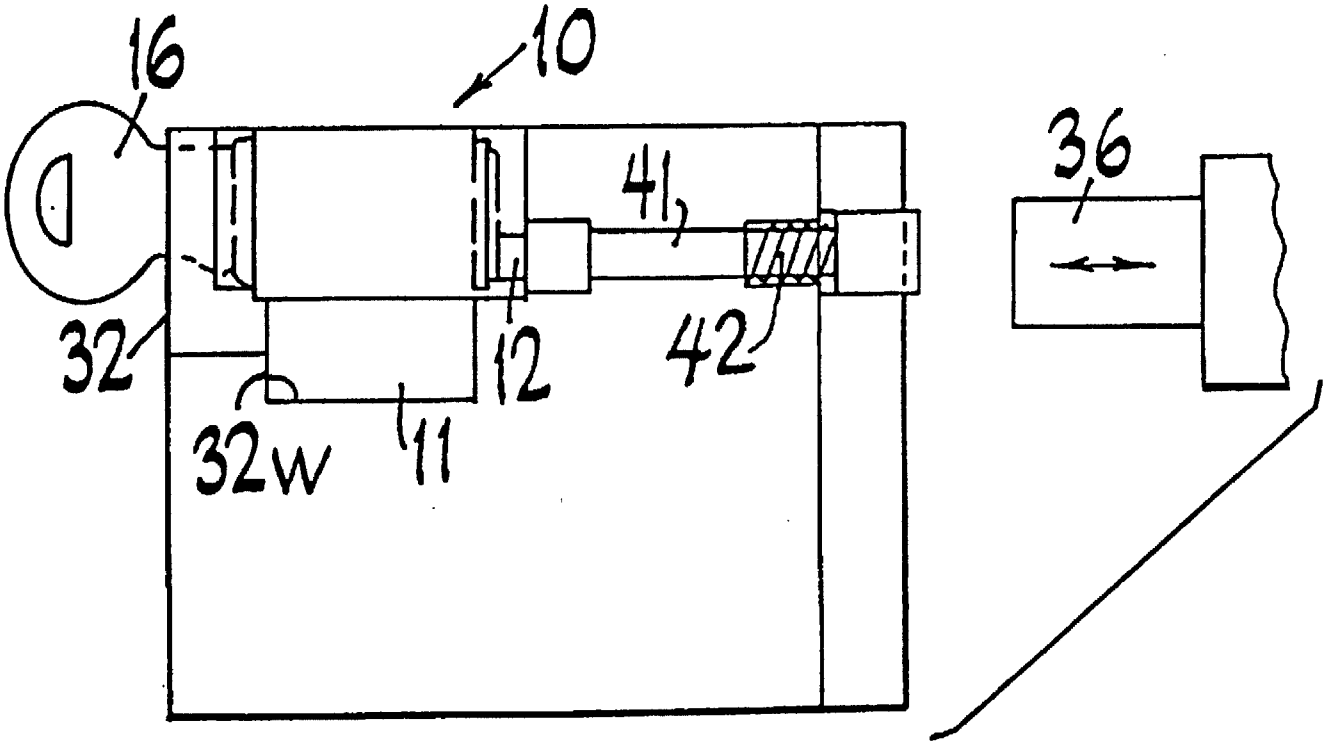
FIG. 5 is an elevational view of the apparatus of FIG. 4.

Turning to FIGS. 4–5, the pin shearing and crimping apparatus 30 includes lock fixture 31 with a configured aperture defining a lock holder recess 32. Lock 10, with its shell 11 and plug 13 and unsheared assembly pins 15*a–e*, is placed in aperture 32 with shell 11 abutting wall 32*w*. Plug tail 12 is engageable with shiftable shear pin 41. Shift shear pin 41 is shown in its rest position biased to the right as viewed in FIG. 4 by spring 42. Also included in apparatus 30 is shearing plunger 36 mounted in a cylindrical opening 37 of a stationary mount block 38, spaced from fixture 31. Apparatus 30 further includes a crimper unit 50 including a crimping ram 52 driven by a solenoid unit E. Crimp shift pin 54 is shown in its rest position biased away from the cylinder shell 11 by crimp pin spring 55.

In operation, lock 10, including shell 11, plug 13, plug tail 12 and key 16, as an assembly, is placed in aperture 32 of fixture 31. Shear pin 41 is hit by shearing plunger 36 to apply force F to cylinder plug tail 12 to move plug 13 in direction Y. Pins 15*a–e* are thereby sheared (FIG. 3). Plug 13 is pushed back by hand, using key 16, to the original position. Next, crimper unit 50 drives crimp shift pin 54 to crimp ring portion segment 20*p* of shell 11 against plug portion 13*a* (see FIGS. 1, 6 and 7).

Figure 8:
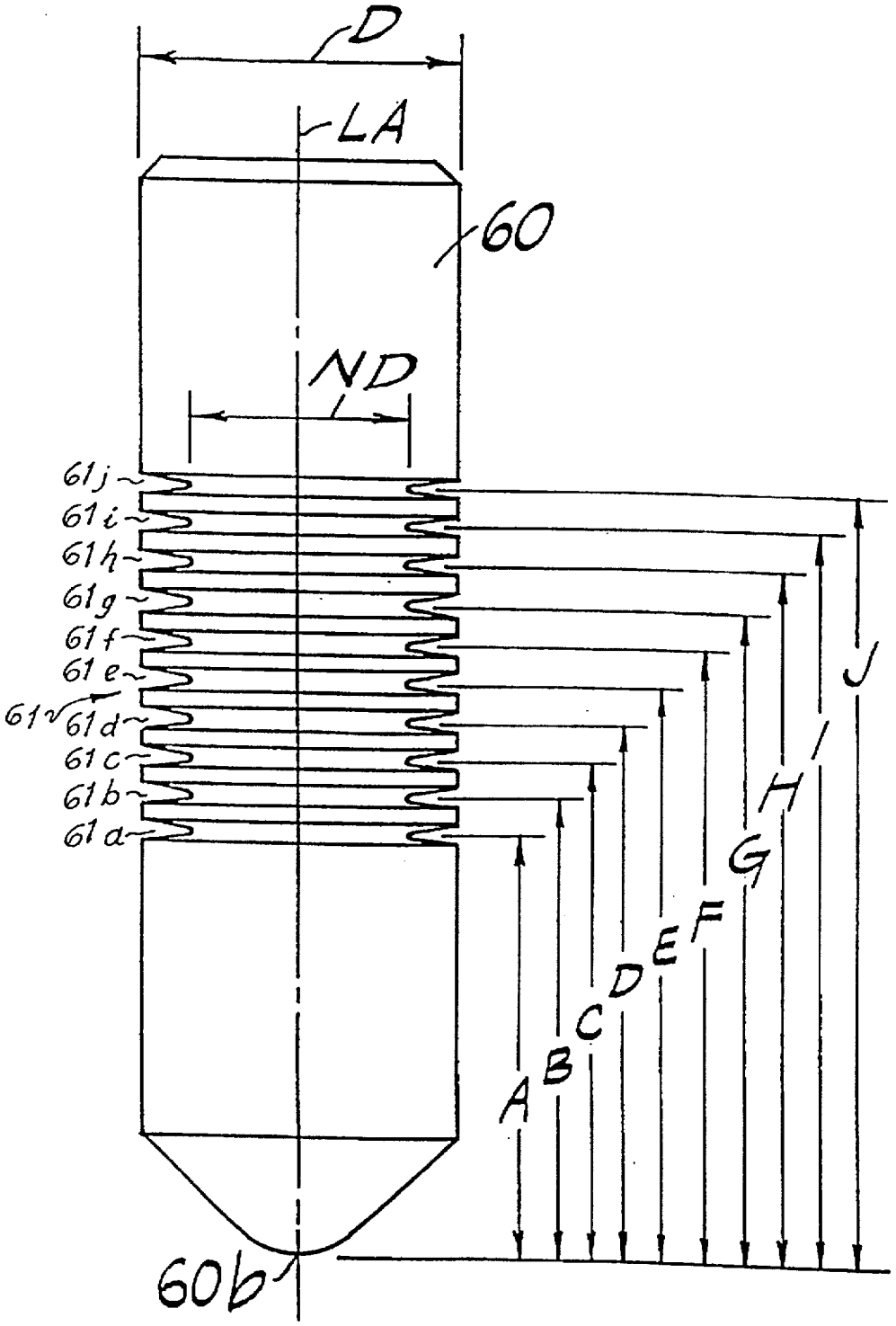
FIG. 8 is an elevational view of the pin of a second embodiment.
Figure 8A:
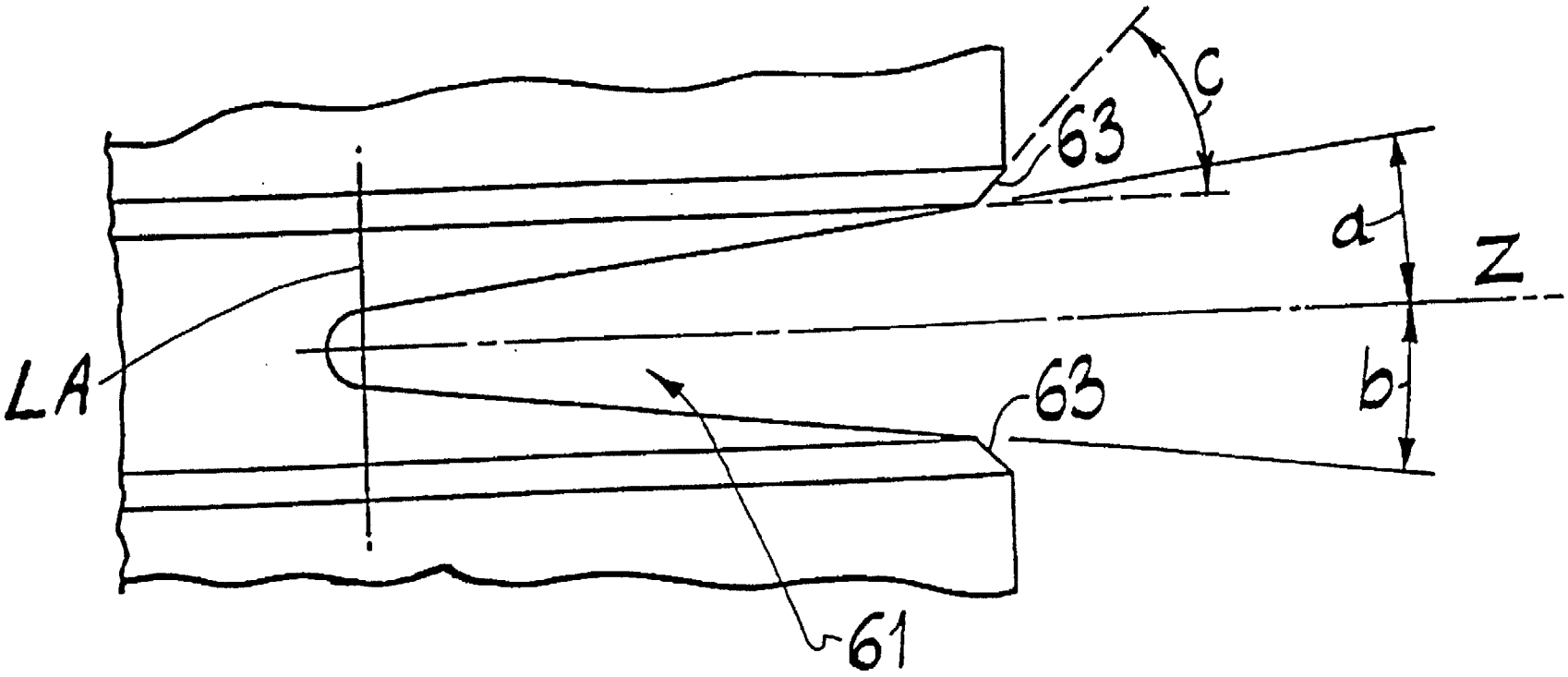
FIG. 8*a* is an enlarged view of a pin groove of the pin of FIG. 8.
Figure 9:
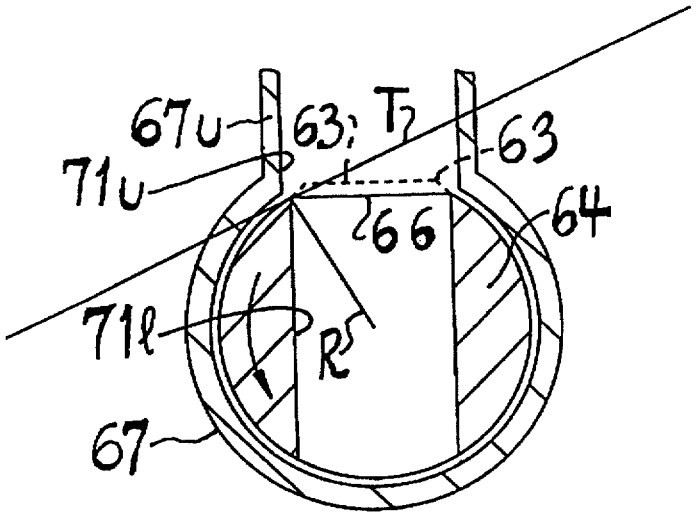
FIG. 9 is a sectional view perpendicular to the horizontal axis of the plug without pins.

Turning to FIGS. 8, 8*a*, 9 and 9*a*, a further embodiment of the invention is shown in which pins have a certain notch configuration and the plug is shaped to facilitate shearing and rotation. Each pin 60 of this embodiment has grooves or notches 61, for example, the ten (10) circumferential grooves 61*a–j* (shown in FIG. 8). Each groove 61 has beveled surface areas or chamfers 63 to facilitate plug rotation and to make picking of the lock more difficult. Each chamfer 63 is sloped at angle C to a plane perpendicular to pin 60's longitudinal axis LA (FIG. 8*a*). The slope of chamfer 63 is parallel to tangent line T which is perpendicular to radius R of plug 64 of shell-plug assembly 65 at the entrance edge of the plug pin passageway 711 (FIG. 9). The selection of such a chamfer slope optimizes the ease of plug rotation. Distances from the bottom key-engaged end 60*b* of pin 60 to the center of each groove is set out in Table 1 (see also FIG. 8).

TABLE 1

| Letter | Distance in Inches |
|---|---|
| A | .166 |
| B | .181 |
| C | .196 |
| D | .211 |
| E | .226 |
| F | .241 |
| G | .256 |
| H | .271 |
| I | .286 |
| J | .301 |

Each notch 61 is comprised of a portion of a notch a above plane Z perpendicular to longitudinal pin axis LA and a notch portion b below line Z.

Figure 9A:
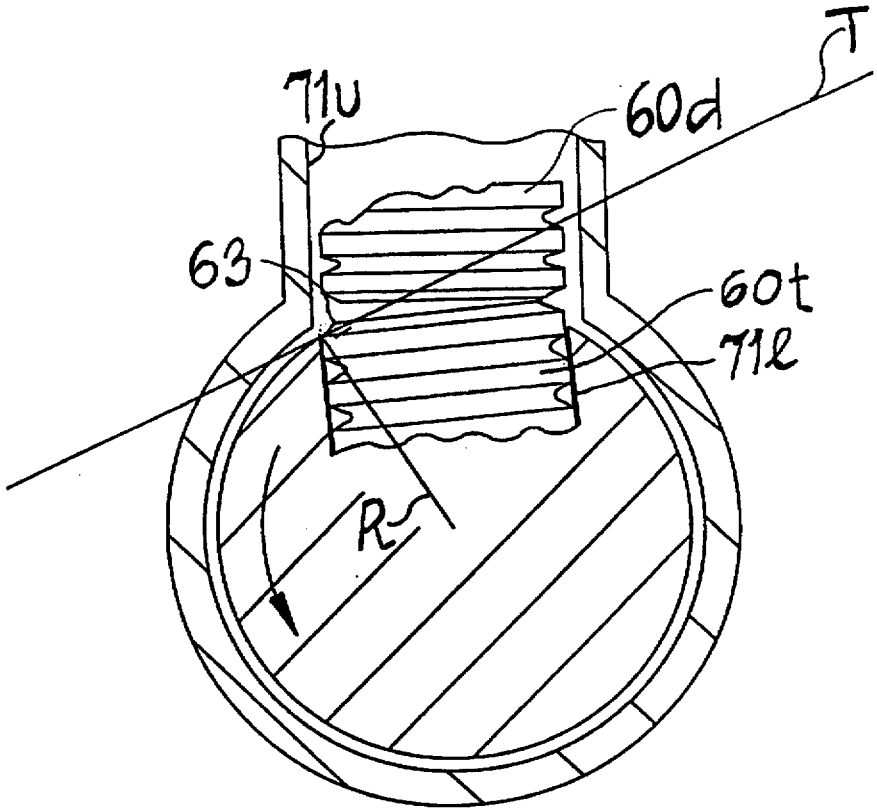
FIG. 9*a* is a sectional view similar to FIG. 9 with pins and with the plug slightly turned.

Plug 64 of shell-plug assembly 65 has a flat surface 66 positioned adjacent the upper shell section 67*u* of shell 67 to define a plug shear line. After shearing, and with the key (not shown) inserted, the formed tumbler pin 60*t* is raised which in turn raises the driver pin 60*d*. As plug 64 is turned in either direction (such as the counterclockwise direction; FIG. 9*a*), groove chamfer surfaces 63 assist in free turning when the lower tumbler pin 60*t* is too high or the bottom of the upper driver pin 60*d* too low. Chamfer surfaces 63 reduce the likelihood that pins will catch the sides of shell and plug passageways 71*u*, 711 in either the shell or in the plug.

Figure 10:
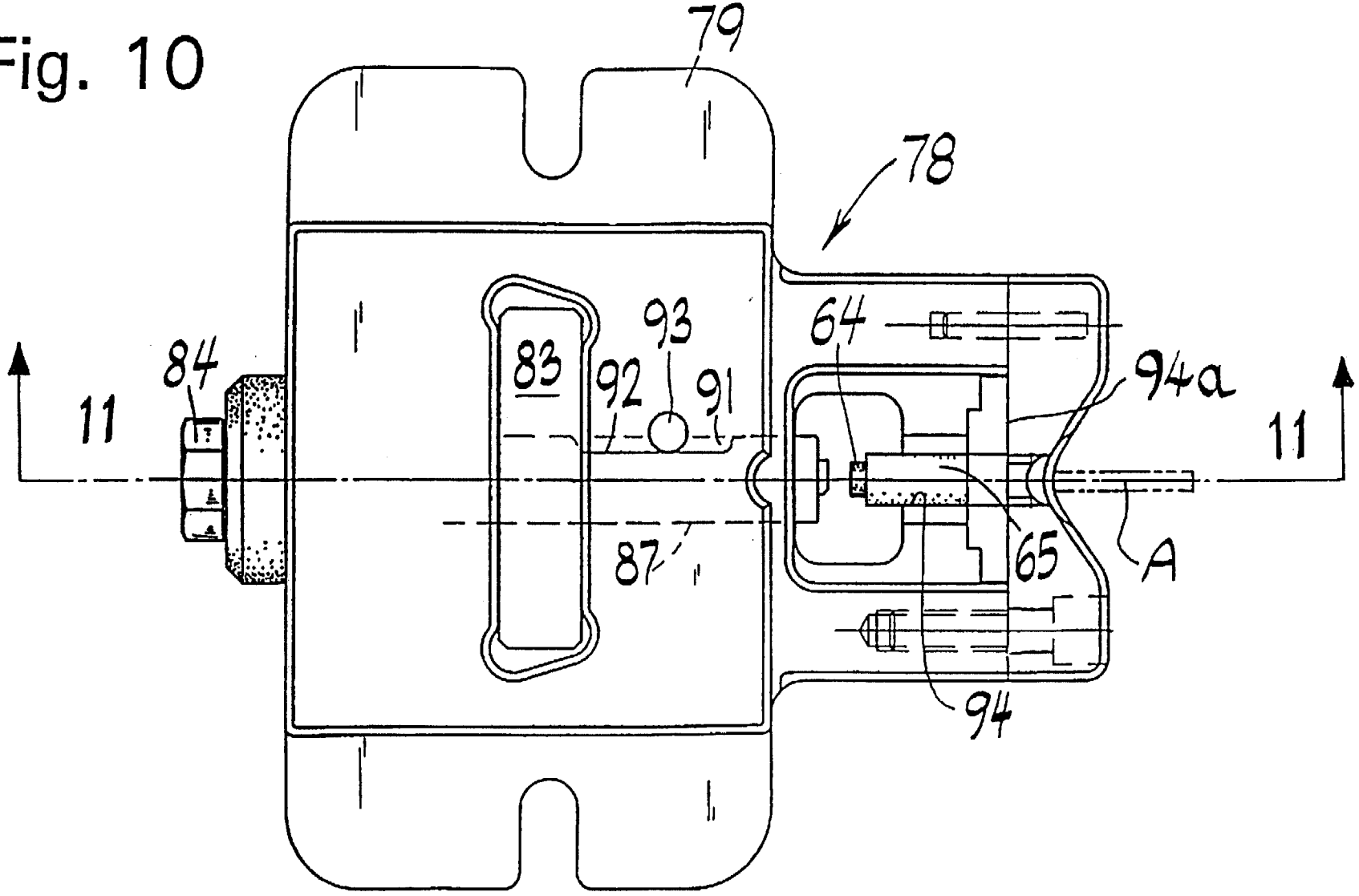
FIG. 10 is a plan view of a second shearing mechanism, with a longitudinal axis A, for use at retail locations.
Figure 11:
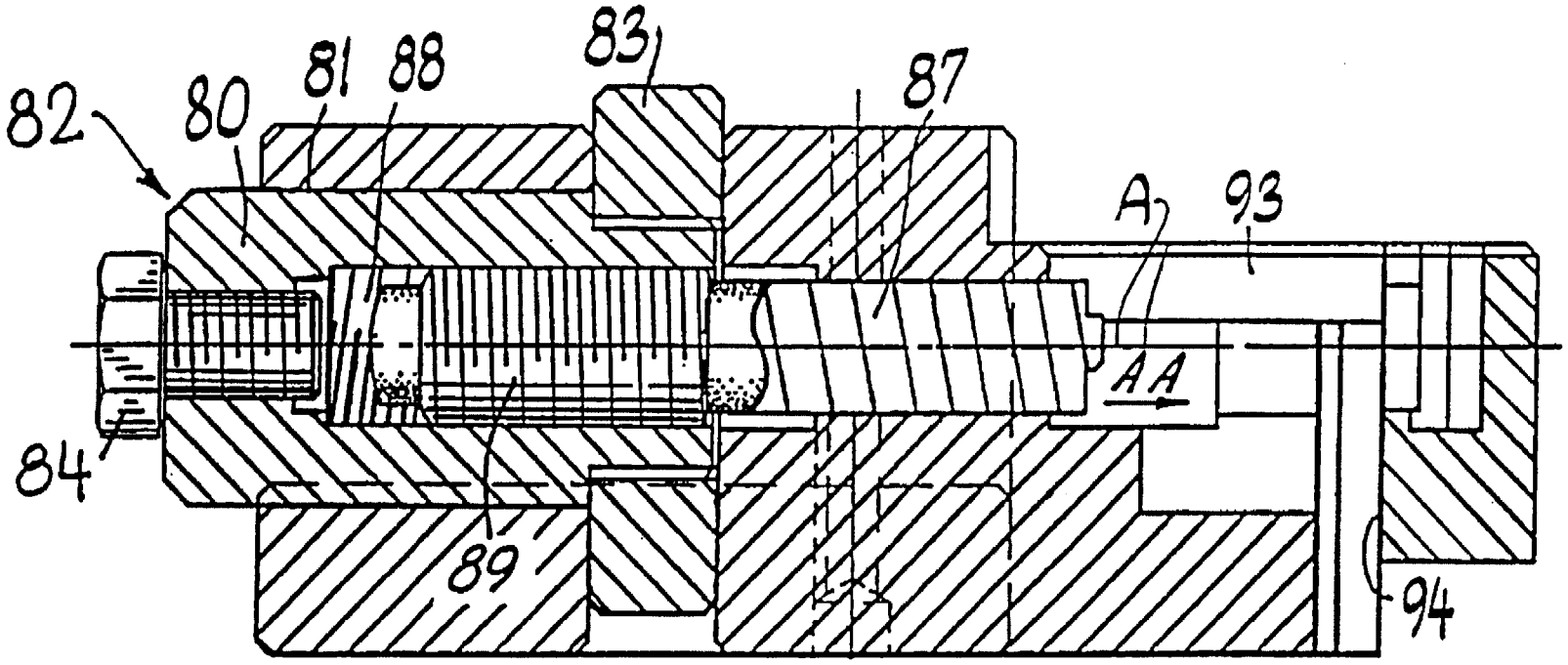
FIG. 11 is a sectional view taken at 11—11 through longitudinal axis A of the mechanism of FIG. 10.
Figure 15:
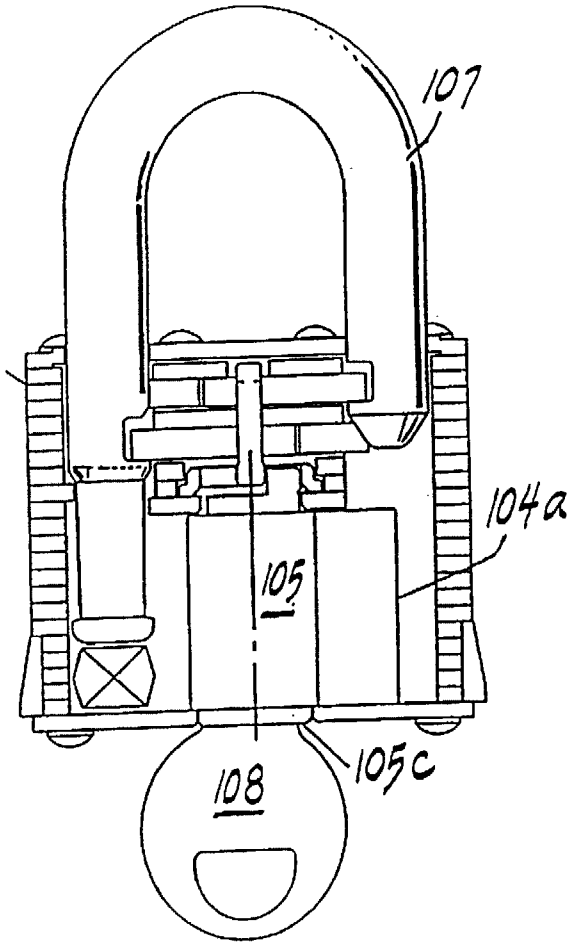
FIG. 15 is a view similar to FIG. 12 in which the shell-plug assembly, after translation, has been placed in the padlock.
Figure 16:
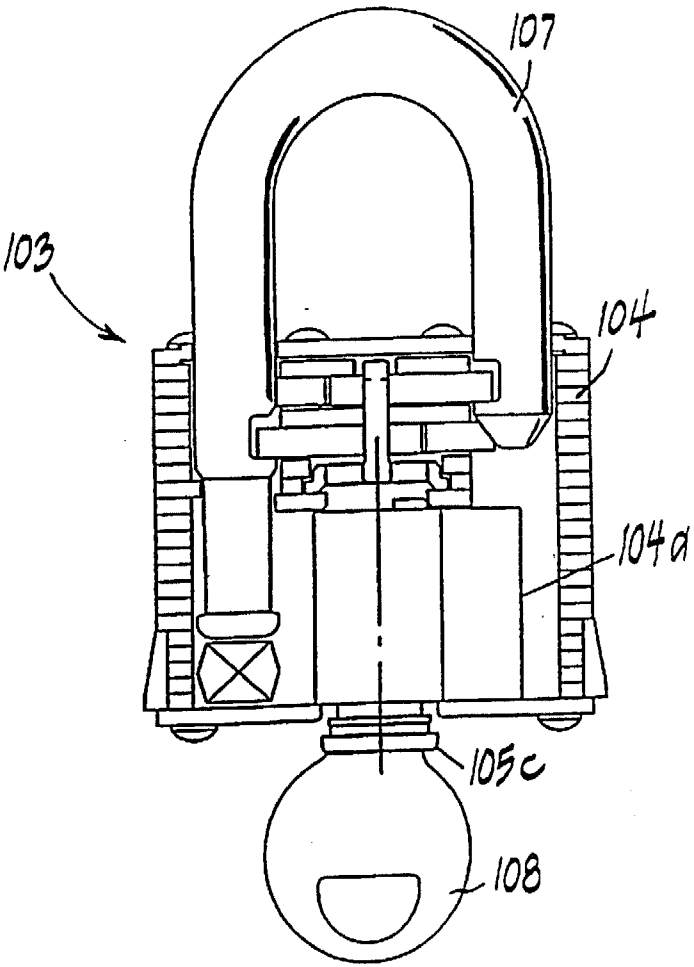
FIG. 16 is an enlarged sectional view along line 16—16 of FIG. 14.

Turning to FIGS. 10 and 11, a pin shearing mechanism 78 is shown having body 79, housing cavity 81, a turnable drive unit 82 mounted in cavity 81 for rotation about the longitudinal axis A (FIG. 11). Turnable unit 82 includes hand wheel 83 and bolt 84 mounted in rotatable drive body 80. Bolt 84 is turnable by a wrench (not shown) to turn drive unit 82. As drive unit 82 is turned it translates plunger 87 through mating threads 88 on body 80 of unit 82 and threads 89 on plunger 87. Plunger 87 moves linearly in direction AA. Plunger 87 is held from turning by indentation 91 having flat surface 92 and by vertical post 93 which engages surface 92 to prevent rotation. Mechanism 78 includes lock holder recess 94 including shell support wall 94*a* which holds the shell-plug assembly 65 against translation in direction AA. In the operation of mechanism 78, the shell-plug assembly 65 is placed in holder recess 94, plunger 87 is advanced until it touches the plug 64 and a wrench is then used to turn bolt 84 to translate plug 64 relative to its shell until the assembly pins 60 shear. After the pins have been sheared, handwheel 83 can be turned in the appropriate direction to rotate drive unit 82 and thereby translate plunger 87 in a direction opposite direction AA. This releases the shell-plug assembly 65 for removal from the mechanism 78.

EXAMPLE

A door lock constructed of five (5) assembly pin passageways 71*u*, 711, defined by aligned shell and plug passageways and assembly pins 60 will, as explained, have each pin 60 sheared to form a pin set (a tumbler pin 60*t* and driver pin 60*d* in tandem). Each assembly pin 60 has an outside diameter D of 0.114 inches and a reduced weakened notch diameter (ND) in the grooves of 0.076 inches (see FIG. 8). Each assembly pin 60 has ten (10) grooves 61*a–j* prior to shearing to create the tumbler-driver pin sets.

Prior to shearing the door lock cylinder is shipped to a locksmith. A customer of the locksmith provides the locksmith with a key used by the customer in operating other locks of the customer. The locksmith inserts the customer's key in the lock, places the lock in the mechanism 78 and shears the assembly pins 60. The customer then installs the door lock in his home, which lock can be served by the customer's existing key.

TABLE 2

| | Pin Characteristics | | | |
|---|---|---|---|---|
| Type | Outside Diameter (D) | Notch Diameter (ND) | In Line F To Shear | Torque To Shear |
| Padlock | .094 in. | .076 in. | 210 lb. | 200 in lb. |
| Door Lock | .114 in. | .076 in. | 210 lb. | 200 in lb. |

The pin notch diameter ND of each of the grooves is selected to provide sufficient strength so that the assembly pins 60 will not fail when a key (or tool of cross section to permit penetration into the keyhole) is torqued. The key (or tool) will fail through breaking, shearing or twisting before the pins 60 shear. As an example, a hardened steel key was inserted into the keyhole of a lock of the present invention and a torque of 240 lb/in was applied to the key. The tool broke without shearing the pins 60. The pin grooves 61*a–j* are also shaped to create fracture or shear surfaces on both tumbler and driver pins which are non-flat and which facilitate lock operation. Finally, grooves 61*a–j* are shaped so that upon fracturing during manufacture or customizing by a locksmith, tumbler and driver pins 60 having end configurations including chamfer surfaces 63 are formed which assist in plug rotation during subsequent operation.

Turning to the embodiment as shown in FIGS. 12–16, padlock 103 includes lock body 104 having shell-plug assembly 104*a* comprised of plug 105 and shell 106. Also shown is shackle 107, key 108 and serrated assembly pins 110.

Figure 13:
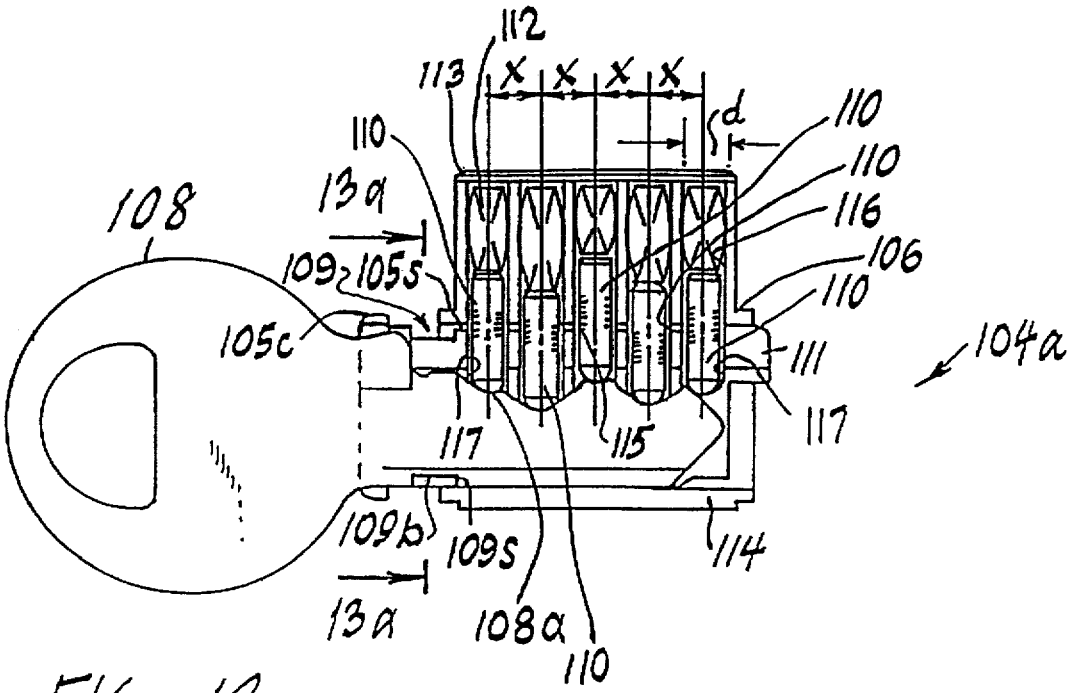
FIG. 13 is a side elevational view of the shell-plug assembly removed from the padlock of FIG. 12.
Figure 13A:
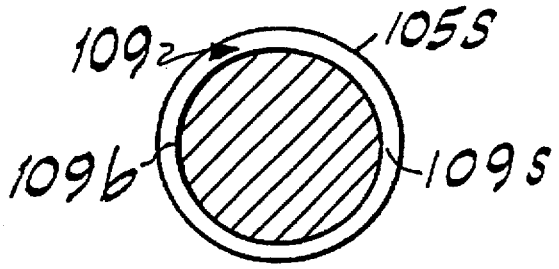
FIG. 13*a* is a sectional view along 13*a*—13*a* of FIG. 13.

Plug 105 includes collar 105*c*, plug circumferential undercut 109, plug surface 105*s*, and plug tail 111. Undercut 109, having bottom 109*b* and sides 109*s*, circumscribes plug 105 (see FIG. 13*a*). Shell 106 includes upper housing portion 113 and lower housing portion 114. Upper housing portion 113 includes five shell pin passageways 116. Plug pin passageways 117 in the lower housing portion are aligned with shell passageways 116. The serrated pins 110 are disposed in these passageways. Key 108 includes four (4) notches 108*a*, which are aligned with the bottoms of the pins 110 when the key is inserted into the keyway of the plug 105. The distance between laterally adjacent centers of passageways 116 and 117, as shown in FIG. 13, is distance X. Also shown in FIGS. 13 and 14 are springs 112 engaging the tops of the pins 110 and urging them downwardly toward the key 108.

Figure 14:
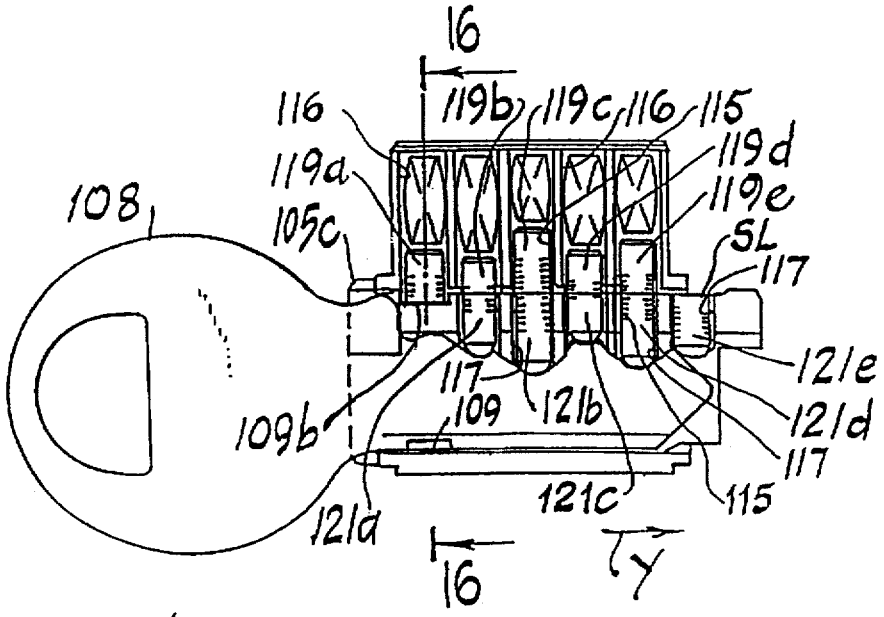
FIG. 14 is a view similar to FIG. 13 in which the plug has been translated in direction Y.
Figure 16:
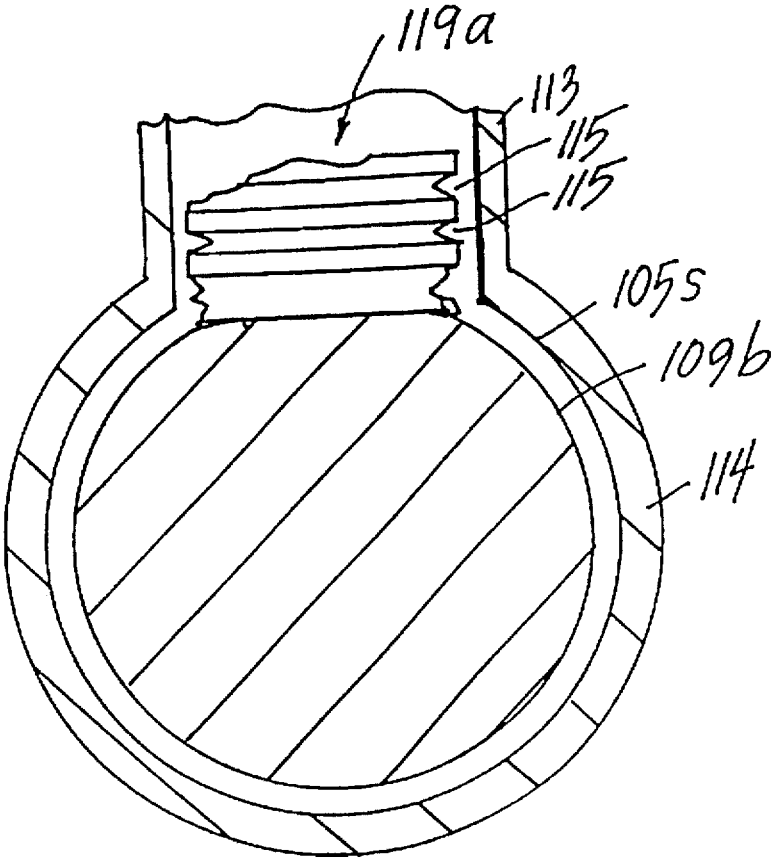

Turning to FIG. 14, plug 105 has been translated in direction Y by a force necessary to shear pins 110 at selected serrations 115 along shear line (SL). By such shearing upper driver pins 119*a–e* and lower tumbler pins 121*a–e* are formed. In addition, the four lower tumbler pins 121*a–d* nearest the keyhole entrance are each moved a distance X to align with the four upper driver pins 119*b–e*. Upper driver pin 119*a* drops down into plug undercut 109 where it is held against undercut bottom 109*b* by spring 112*a*. With upper driver pin 119*a* so positioned, plug 105 can turn but cannot be withdrawn from shell 106 because sides 109*s* engage upper driver pin 119*a*. This anti-withdrawal feature adds to the security of padlock 103. Lower tumbler pin 121*e* becomes inactive in its plug passageway 117, which serves as pin section entrapment hole.

As is seen in the Figures, passageways 116 and 117 have diameter dimensions of d. Pins 110 are substantially the same but slightly less in diameter than the passageways. The spacing between the passageways is small enough so that an adjacent pin, such as tumbler pin 121*a* supports an upper driver pin such as driver pin 119*b* before tumbler pin 121*b* has moved out from under driver pin 119*b* (see FIG. 14).

Alternatively, the anti-withdrawal feature of the present invention is also useful in conventional pin tumbler locks where tumbler and driver pins are first formed and then assembled. In such a lock an additional shell passageway and aligned plug passageway are formed into which is placed a shearable pin. The plug includes an undercut. When the plug and a shell are assembled, the pin is sheared and a portion enters the plug undercut to prevent plug withdrawal while permitting plug rotation in the shell.

We claim:

1. A method for manufacturing a lock having a shell, a turnable plug rotatably mounted within said shell and having a keyhole for insertion of a key, a shear line between the shell and plug, a plurality of aligned shell and plug passageways, and assembly pins in said passageways, comprising the steps of:

a) positioning said shell and plug with said shell held against movement relative to said plug and with the shell passageways aligned with the plug passageways and with an assembly pin located within each aligned shell and plug passageway, each assembly pin having a series of spaced weakened zones and a strength such that application of a first shearing force to said assembly pins equal to or less than the maximum rotative force that can be applied to said plug through said keyhole by every key-like tool that can be inserted into said keyhole will not shear said assembly pins along said weakened zones;

b) aligning a selected weakened zone of each assembly pin with each other for shearing; and c) thereafter shearing said assembly pins along said selected weakened zones by application of a second shearing force larger than said maximum rotative force along the shear line to shear each assembly pin into two pin sections.

2. The method of claim 1 in which the plug has a flat outer surface through which each of said pin passageways in the plug extends, the method wherein:

a) said second shearing force is applied along said flat surface.

3. A method for manufacturing a lock having a shell, a turnable plug mounted within said shell and having a keyhole and an annular undercut, a shear line between the shell and plug, a plurality of shell passageways in the shell, a plurality of aligned plug passageways in the plug, and a selectively-weakened assembly pin in each of said aligned shell and plug passageways; comprising the steps of:

a) shearing each assembly pin by application of a shearing force which translates the plug along the shear line to shear each pin into two pin sections, one a shell driver pin and the other a plug tumbler pin; and b) further translating the plug in the shell to align a shell passageway with said plug undercut.

4. The method of claim 3 in which one sheared driver pin is partially disposed in said undercut after said further plug translating, and each sheared driver pin other than said one sheared driver pin which is disposed in the undercut is supported by an adjacent tumbler pin after said further plug translating.

5. The method of manufacturing a lock having a shell with a longitudinal shell axis and a plurality of adjacent shell passageways disposed along said shell axis, a turnable plug, having a longitudinal plug axis, mounted within said shell for rotation about said plug axis and having a keyhole and a plurality of adjacent plug passageways disposed along said plug axis and aligned with said shell passageways, and a shearable assembly pin in each aligned shell and plug passageway, said shell and plug defining a shear line between the shell and the plug, and said plug being located axially along said shell axis at a first axial position in which said shell and plug passageways are in a first aligned position, the method comprising:

a) moving said plug axially within said shell to a second axial position to shear each assembly pin along said shear line into a sheared driver pin disposed in each shell passageway and a sheared tumbler pin disposed in each plug passageway; and b) aligning said shell passageways with said plug passageways in a second aligned position in which the sheared driver pin in any one aligned shell passageway is a sheared part of the tumbler pin in the next adjacent aligned plug passageway, with the tumbler pin in each plug passageway abutting the driver pin in the aligned shell passageway at said shear line when a key for said lock is inserted into said keyhole.

6. The method of claim 5 further comprising:

a) fixing the plug in said second axial position.

7. The method of manufacturing a lock having a shell with a longitudinal shell axis and a plurality of adjacent shell passageways disposed along said shell axis, a turnable plug, having a longitudinal plug axis, mounted within said shell for rotation about said plug axis and having a keyhole, an annular undercut and a plurality of adjacent plug passageways disposed along said plug axis and aligned with said shell passageways, a shearable assembly pin in each aligned shell and plug passageway, and a spring means in each of said shell passageways to urge said assembly pins into said plug passageways, said shell and plug defining a shear line between the shell and the plug, and said plug being located axially along said shell axis at a first axial position in which said shell and plug passageways are in a first aligned position and said annular undercut is spaced along said plug axis from said first aligned position of said shell and plug passageways, the method comprising:

a) moving said plug axially within said shell to a second axial position to shear each assembly pin along said shear line into a sheared driver pin disposed in each shell passageway and a sheared tumbler pin disposed in each plug passageway; and b) aligning said shell passageways with one shell passageway aligned with said plug undercut and with the driver pin in the one shell passageway extending into said plug undercut under the influence of said spring means and with the remaining shell passageways aligned with plug passageways in a second aligned position in which the sheared driver pin in any one aligned shell passageway is a sheared part of the tumbler pin in the next adjacent aligned plug passageway, with the tumbler pin in each aligned plug passageway abutting the driver pin in the aligned shell passageway at said shear line when a key for said lock is inserted into said keyhole.

* * * * *

UNITED STATES PATENT AND TRADEMARK OFFICE

CERTIFICATE OF CORRECTION

PATENT NO. : 5,735,153

DATED : April 7, 1998

INVENTOR(S) : Hanneman et al.

It is certified that error appears in the above-identified patent and that said Letters Patent is hereby corrected as shown below:

On the title page and column 1, line 1, change "LUCK" to --LOCK--.

Signed and Sealed this

Ninth Day of June, 1998

*Attest:*

*Attesting Officer*

BRUCE LEHMAN

*Commissioner of Patents and Trademarks*